US008729007B2

(12) United States Patent
Sadlowski et al.

(10) Patent No.: US 8,729,007 B2
(45) Date of Patent: May 20, 2014

(54) ACIDIC LAUNDRY DETERGENT COMPOSITIONS COMPRISING ALKYL BENZENE SULFONATE

(71) Applicant: The Procter & Gamble Company, Cincinnati, OH (US)

(72) Inventors: Eugene Steven Sadlowski, Cincinnati, OH (US); Cheyne Thomas, Independence, KY (US); Peter De Nies, Putte (BE); Nilgun Esin Aksoy, Strombeek Bever (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/743,374

(22) Filed: Jan. 17, 2013

(65) Prior Publication Data

US 2013/0184195 A1 Jul. 18, 2013

Related U.S. Application Data

(60) Provisional application No. 61/587,773, filed on Jan. 18, 2012.

(51) Int. Cl.
*C11D 1/83* (2006.01)
*C11D 7/26* (2006.01)

(52) U.S. Cl.
USPC ..... 510/340; 510/276; 510/289; 510/290; 510/351; 510/356; 510/357; 510/421; 510/422; 510/426; 510/427; 510/477

(58) Field of Classification Search
USPC ..... 510/276, 289, 290, 340, 351, 356, 357, 510/421, 422, 426, 427, 477
See application file for complete search history.

(56) References Cited

U.S. PATENT DOCUMENTS

| | | | | |
|---|---|---|---|---|
| 5,484,555 | A | 1/1996 | Schepers | |
| 5,536,438 | A | 7/1996 | Scialla et al. | |
| 5,559,090 | A * | 9/1996 | Scialla et al. | 510/303 |
| 5,763,382 | A | 6/1998 | Cooper et al. | |
| 5,851,979 | A * | 12/1998 | Scialla et al. | 510/417 |
| 5,972,869 | A | 10/1999 | Cao et al. | |
| 6,066,610 | A | 5/2000 | Sramek | |
| 6,093,856 | A | 7/2000 | Cripe et al. | |
| 6,136,769 | A | 10/2000 | Asano et al. | |
| 6,183,757 | B1 * | 2/2001 | Beerse et al. | 424/401 |
| 6,303,556 | B1 * | 10/2001 | Kott et al. | 510/357 |
| 6,376,449 | B2 | 4/2002 | Olsen et al. | |
| 7,030,046 | B2 * | 4/2006 | Wong et al. | 442/154 |
| 7,148,187 | B1 | 12/2006 | Simon et al. | |
| 7,449,436 | B2 | 11/2008 | Gambogi et al. | |
| 7,470,653 | B2 | 12/2008 | Gambogi et al. | |
| 2006/0111261 | A1 * | 5/2006 | Sadlowski et al. | 510/221 |
| 2007/0191253 | A1 | 8/2007 | Kilkenny et al. | |
| 2007/0238631 | A1 | 10/2007 | Gambogi et al. | |
| 2008/0026978 | A1 | 1/2008 | Gambogi et al. | |
| 2008/0248988 | A1 | 10/2008 | Gambogi et al. | |
| 2009/0048143 | A1 | 2/2009 | Iverson et al. | |
| 2009/0215854 | A1 * | 8/2009 | Pan et al. | 514/423 |
| 2009/0312225 | A1 | 12/2009 | Szewczyk et al. | |
| 2009/0312226 | A1 | 12/2009 | Szewczyk et al. | |
| 2009/0312227 | A1 | 12/2009 | Murphy et al. | |
| 2011/0146707 | A1 | 6/2011 | Cermenati et al. | |
| 2011/0146725 | A1 * | 6/2011 | Woo et al. | 134/26 |
| 2011/0269659 | A2 | 11/2011 | Chapman et al. | |
| 2012/0087962 | A1 * | 4/2012 | Biedermann et al. | 424/402 |
| 2013/0061402 | A1 | 3/2013 | Frankenbach et al. | |

FOREIGN PATENT DOCUMENTS

| | | | |
|---|---|---|---|
| EP | 0 845 526 | A2 | 11/1997 |
| GB | 2379223 | A | 3/2003 |
| JP | 2005206833 | A | 8/2005 |
| JP | 2007308592 | A | 11/2007 |
| JP | 2008150499 | A | 7/2008 |
| WO | WO 00/27958 | A1 | 5/2000 |
| WO | WO 2009/154614 | A1 | 12/2009 |
| WO | WO 2009/154615 | A1 | 12/2009 |
| WO | WO 2009/154616 | A1 | 12/2009 |
| WO | WO 2009/155314 | A1 | 12/2009 |

OTHER PUBLICATIONS

U.S. Appl. No. 13/472,526, filed May 16, 2012, Scartozzi, et al.
U.S. Appl. No. 61/827,131, filed May 24, 2013, Gaddis.
U.S. Appl. No. 61/827,138, filed May 24, 2013, Delaney.
U.S. Appl. No. 61/827,147, filed May 24, 2013, Delaney.
U.S. Appl. No. 61/827,155, filed May 24, 2013, Holder.
U.S. Appl. No. 61/827,373, filed May 24, 2013, Frankenbach.
PCT Search Report Dated Apr. 29, 2013; 16 Pages.

* cited by examiner

*Primary Examiner* — Charles Boyer
(74) *Attorney, Agent, or Firm* — Melissa G. Krasovec; Steven W. Miller

(57) ABSTRACT

An acidic laundry detergent composition comprising less than about 20% of a surfactant system comprising surfactants selected from the group consisting of anionic surfactants, nonionic surfactants, cationic surfactants and mixtures thereof, wherein the surfactant system has a Hydrophilic Index of greater than or equal to about 9.00 and an organic acidulant at a level such that the ratio of surfactant system to organic acidulant is less or equal to about 3.0 and an alkaline neutralizer added in an amount necessary to raise the neat pH of the detergent composition above or equal to about 2.5 but no higher than or equal to about 3.0.

17 Claims, No Drawings

ACIDIC LAUNDRY DETERGENT COMPOSITIONS COMPRISING ALKYL BENZENE SULFONATE

FIELD OF THE INVENTION

The present invention relates to laundry detergent compositions which are capable of delivering an acidic wash pH to the wash water of a standard fabric washing machine.

BACKGROUND OF THE INVENTION

Numerous laundry treatment compositions are available for use by consumers in the washing of clothing and other fabrics in traditional washing machines. However, consumers still struggle to remove some residues and/or stains from fabric items. Some of the more problematic consumer fabric cleaning problems originate from complex mixtures of accumulated body soils (especially in the underarm and collar areas) with detergent, fabric softener, and hard water residues. Such residues can additionally include other soil, detergent, fabric softener and/or hard water components that were redeposited during previous washes. The build up of these residues over time leads to a loss of whiteness and/or brightness and may create a dingy appearance to fabric.

Detergent compositions, particularly liquid laundry detergents, are formulated to contain one or more surfactants (often anionic surfactants), electrolyte materials, and other adjuvants dispersed or dissolved in an aqueous medium. Traditionally they have been formulated to a composition pH of above 7. The main reason for the popularity of a basic pH is to ensure that the surfactant systems, enzymes or other organic solvents remain solubilized and disperse in the wash water and that greasy or oily stains removed from soiled clothing are also dispersed in the wash water.

A number of acidic laundry detergent formulations have been disclosed in the past to consumers which teach the benefits of improved removal of residues from fabrics and associated improvement in whiteness, improved bleachable stain removal and improved anti-bacterial performance. However, those products often give uncontrolled sudsing and do not provide adequate cleaning form grease stains.

Therefore, a need still exists for laundry detergent formulation having a high water content, that is still capable of reducing or eliminating the residues on fabrics associated with mixtures of accumulated body soils, detergent, fabric softener and/or hard water that is traditionally associated with low pH detergents, but also delivering improved suds control and grease stain improvement.

SUMMARY OF THE INVENTION

It has now surprisingly been found that laundry detergents, especially heavy duty liquid laundry detergents that are capable of providing a pH of around 6 in the wash water of a standard washing machine can be useful for breaking up the dingy-causing deposits on fabrics, providing improved cleaning of grease stains like taco grease or canola oil and cleaning of bleachable stains like tea and wine.

The invention encompasses an acidic laundry detergent composition comprising less than about 20% by weight of the detergent of a surfactant system comprising surfactants selected from the group consisting of anionic surfactants, nonionic surfactants, cationic surfactants and mixtures thereof, wherein the surfactant system has a Hydrophilic Index of greater than or equal to about 9.00; and an organic acidulant at a level such that the ratio of surfactant system to organic acidulant is less or equal to about 3.0 and an alkaline neutralizer added in an amount necessary to raise the neat pH of the detergent composition above or equal to about 2.5 but no higher than or equal to about 3.0.

The invention further encompasses a laundry detergent as above wherein the detergent composition is a liquid laundry detergent composition having a viscosity of from about 150 to about 1,500 mPa·s.

The invention further encompasses a laundry detergent composition according to above wherein the composition is substantially free of enzymes.

The invention further encompasses a laundry detergent composition according to above wherein the composition is substantially free of fatty acid compounds.

The invention further encompasses a laundry detergent composition according to above wherein the composition comprises from about 0.5 to about 10% of the organic acidulant.

The invention further encompasses a laundry detergent composition according to above wherein the composition further comprises a laundry adjunct material selected from builders, polymers, brighteners, perfumes, and mixtures thereof.

The invention further encompasses a method of laundering fabrics which provides reduction of fabric dinginess, said method comprising the steps of:

a) providing a detergent composition according to above;
b) providing a wash water;
c) introducing said detergent composition into said wash water in an amount sufficient to generate a pH of from about 5 to about 6.5 in the wash water.

The invention further encompasses a method of laundering fabrics according to above wherein after the detergent composition is introduced into the wash water, the wash water comprises from about 0.02 to about 4.0%, by weight of the wash water, of the detergent composition.

The invention further encompasses a method of laundering fabrics which provides reduction of fabric dinginess, said method comprising the steps of:

a) providing a detergent composition according to above;
b) providing a wash water;
c) introducing said detergent composition into said wash water in an amount sufficient to generate a pH of from about 5 to about 6.5 in the wash water.

The invention further encompasses a laundry detergent composition according to above wherein after the detergent composition is introduced into the wash water, the wash water comprises from about 0.04 to about 2.0%, by weight of the wash water, of the detergent composition.

DETAILED DESCRIPTION OF THE INVENTION

The essential and optional components of laundry treatment compositions herein, as well as composition form, preparation and use, are described in greater detail as follows:

In this description, all concentrations and ratios are on a weight basis of the laundry treatment composition unless otherwise specified. Elemental compositions such as percentage nitrogen (% N) are percentages by weight.

Molecular weights of polymers are number average molecular weights unless otherwise specifically indicated.

The terms "substantially free of" or "substantially free from" may be used herein. This means that the indicated material is at the very minimum not deliberately added to the composition to form part of it, or, preferably, is not present at analytically detectable levels. It is meant to include compositions whereby the indicated material is present only as an impurity in one of the other materials deliberately included.

Laundry Detergent Composition

The laundry detergent compositions of the present invention may be in liquid or gel form. In one specific embodiment, the compositions are liquid in form and comprise heavy duty liquid compositions.

Surfactant System

The laundry detergent composition comprises a surfactant system in an amount sufficient to provide desired cleaning properties. In one embodiment, the laundry detergent composition comprises, by weight of the composition, less than or equal to about 20%. Certain embodiments may comprise from about 5% to about 18% of the surfactant system. The surfactant system may comprise anionic, nonionic, cationic, and mixtures thereof.

The surfactant system of the present invention is hydrophobic. That is, it has a "Hydrophilic Index" (HI) greater than or equal to about 9.0 and may range from about 9 to about 11.0. Any combination of surfactants that provide for a hydrophobic surfactant system having a "Hydrophilic Index" greater than or equal to about 9, are of use.

Anionic Surfactant

In one embodiment, the surfactant systems herein include from about 5% to about 60%, preferably from about 10% to about 50%, by weight of the detergent composition, of an anionic surfactant system. Certain embodiments may comprise from about 25% to about 45% anionic surfactant.

Suitable anionic surfactants useful herein include the alkyl benzene sulfonic acids and their salts.

Exemplary anionic surfactants are the alkali metal salts of $C_{10-16}$ alkyl benzene sulfonic acids, preferably $C_{11-14}$ alkyl benzene sulfonic acids. Preferably the alkyl group is linear and such linear alkyl benzene sulfonates are known as "LAS". Alkyl benzene sulfonates, and particularly LAS, are well known in the art. Such surfactants and their preparation are described for example in U.S. Pat. Nos. 2,220,099 and 2,477,383. In one embodiment, the alkyl benzene sulfonates surfactant is selected from sodium and potassium linear straight chain alkylbenzene sulfonates in which the average number of carbon atoms in the alkyl group is from about 11 to 14. Sodium $C_{11}$-$C_{14}$. For example, $C_{12}$, LAS is a specific example of such surfactants.

Generally speaking, anionic surfactants useful herein are disclosed in U.S. Pat. No. 4,285,841, Barrat et al., issued Aug. 25, 1981, and in U.S. Pat. No. 3,919,678, Laughlin, et al., issued Dec. 30, 1975.

Useful anionic surfactants also include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid group. (Included in the term "alkyl" is the alkyl portion of aryl groups.) Other anionic surfactants useful herein are the water-soluble salts of: paraffin sulfonates and secondary alkane sulfonates containing from about 8 to about 24 (preferably about 12 to 18) carbon atoms; alkyl glyceryl ether sulfonates, especially those ethers of $C_{8-18}$ alcohols (e.g., those derived from tallow and coconut oil).

Mixtures of the alkylbenzene sulfonates with the above-described paraffin sulfonates, secondary alkane sulfonates and alkyl glyceryl ether sulfonates are also useful.

Nonionic Surfactant

In addition to the anionic surfactant system, the laundry detergent compositions of the present invention may further contain a nonionic surfactant. The compositions of the present invention may contain up to about 80% nonionic surfactant. In one embodiment from about 25% to about 80%, alternatively from about 40% to about 70%, by weight of the detergent composition, of an ethoxylated nonionic surfactant.

The nonionic surfactant may be ethoxylated nonionic surfactants. These materials are described in U.S. Pat. No. 4,285,841, Barrat et al, issued Aug. 25, 1981. In one embodiment, the nonionic surfactant is selected from the ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. These surfactants are more fully described in U.S. Pat. No. 4,284,532, Leikhim et al, issued Aug. 18, 1981. In one embodiment, the nonionic surfactant is selected from ethoxylated alcohols having an average of from about 10 to about 15 carbon atoms in the alcohol and an average degree of ethoxylation of from about 3 to about 12 moles of ethylene oxide per mole of alcohol.

Without being limited by theory, it is believed that the addition of an ethoxylated nonionic surfactant to the detergent compositions of the invention herein is helpful in providing physical stability to the detergent product, i.e., preventing phase splits and precipitation. This is particularly true for compositions containing high levels of quaternary ammonium agent and/or low levels of anionic surfactant. Therefore, one embodiment of the invention herein comprises at least about 0.1%, by weight of the detergent composition, of the nonionic surfactant in the detergent compositions herein.

Suitable nonionic surfactants useful herein can comprise any of the conventional nonionic surfactant types typically used in liquid or gel detergent products. These include alkoxylated fatty alcohols and amine oxide surfactants. Preferred for use in the liquid detergent products herein are those nonionic surfactants which are normally liquid.

Suitable nonionic surfactants for use herein include the alcohol alkoxylate nonionic surfactants. Alcohol alkoxylates are materials which correspond to the general formula: $R^1(C_mH_{2m}O)_nOH$ wherein $R^1$ is a $C_8$-$C_{16}$ alkyl group, m is from 2 to 4, and n ranges from about 2 to 12. Preferably $R^1$ is an alkyl group, which may be primary or secondary, that contains from about 9 to 15 carbon atoms, more preferably from about 10 to 14 carbon atoms. In one embodiment, the alkoxylated fatty alcohols will also be ethoxylated materials that contain from about 2 to 12 ethylene oxide moieties per molecule, alternatively from about 3 to 10 ethylene oxide moieties per molecule.

The alkoxylated fatty alcohol materials useful in the detergent compositions herein will frequently have a hydrophilic-lipophilic balance (HLB) which ranges from about 3 to 17. In one embodiment, the HLB of this material will range from about 6 to 15, alternatively from about 8 to 15. Alkoxylated fatty alcohol nonionic surfactants have been marketed under the tradenames Neodol and Dobanol by the Shell Chemical Company.

Another suitable type of nonionic surfactant useful herein comprises the amine oxide surfactants. Amine oxides are materials which are often referred to in the art as "semi-polar" nonionics. Amine oxides have the formula: $R(EO)_x(PO)_y(BO)_zN(O)(CH_2R')_2.qH_2O$. In this formula, R is a relatively long-chain hydrocarbyl moiety which can be saturated or unsaturated, linear or branched, and can contain from 8 to 20, in one embodiment from 10 to 16 carbon atoms, and is alternatively a $C_{12}$-$C_{16}$ primary alkyl. R' is a short-chain moiety, and may be selected from hydrogen, methyl and —$CH_2OH$.

When x+y+z is different from 0, EO is ethyleneoxy, PO is propyleneneoxy and BO is butyleneoxy. Amine oxide surfactants are illustrated by $C_{12-14}$ alkyldimethyl amine oxide.

Non-limiting examples of nonionic surfactants useful herein include: a) $C_{12}$-$C_{18}$ alkyl ethoxylates, such as, NEODOL® nonionic surfactants from Shell; b) $C_6$-$C_{12}$ alkyl phenol alkoxylates wherein the alkoxylate units are a mixture of ethyleneoxy and propyleneoxy units; c) $C_{12}$-$C_{18}$ alcohol and $C_6$-$C_{12}$ alkyl phenol condensates with ethylene oxide/propylene oxide block polymers such as Pluronic® from BASF; d) $C_{14}$-$C_{22}$ mid-chain branched alcohols, BA, as discussed in U.S. Pat. No. 6,150,322; e) $C_{14}$-$C_{22}$ mid-chain branched alkyl alkoxylates, $BAE_x$, wherein x 1-30, as discussed in U.S. Pat. No. 6,153,577, U.S. Pat. No. 6,020,303 and U.S. Pat. No. 6,093,856; f) Alkylpolysaccharides as discussed in U.S. Pat. No. 4,565,647 to Llenado, issued Jan. 26, 1986; specifically alkylpolyglycosides as discussed in U.S. Pat. No. 4,483,780 and U.S. Pat. No. 4,483,779; g) Polyhydroxy fatty acid amides as discussed in U.S. Pat. No. 5,332,528, WO 92/06162, WO 93/19146, WO 93/19038, and WO 94/09099; and h) ether capped poly(oxyalkylated) alcohol surfactants as discussed in U.S. Pat. No. 6,482,994 and WO 01/42408.

Anionic/Nonionic Combinations

In the laundry detergent compositions herein, the surfactant system may comprise combinations of anionic and nonionic surfactant materials. When this is the case, the weight ratio of anionic to nonionic will typically range from 10:90 to 95:5, more typically from 30:70 to 70:30.

Cationic Surfactant

In addition to the anionic and nonionic surfactants, the laundry detergent compositions of the present invention may further comprise up to about 20% by weight of the detergent composition of cationic surfactants. Cationic surfactants are well known in the art and non-limiting examples of these include quaternary ammonium surfactants, which can have up to 26 carbon atoms. Additional examples include a) alkoxylate quaternary ammonium (AQA) surfactants as discussed in U.S. Pat. No. 6,136,769; b) dimethyl hydroxyethyl quaternary ammonium as discussed in U.S. Pat. No. 6,004,922; c) trimethyl quaternary ammonium such as lauryl trimethyl quaternary ammonium d) polyamine cationic surfactants as discussed in WO 98/35002, WO 98/35003, WO 98/35004, WO 98/35005, and WO 98/35006; e) cationic ester surfactants as discussed in U.S. Pat. Nos. 4,228,042, 4,239,660 4,260,529 and U.S. Pat. No. 6,022,844; and e) amino surfactants as discussed in U.S. Pat. No. 6,221,825 and WO 00/47708, specifically amido propyldimethyl amine (APA).

Viscosity

The detergent compositions of the present invention have a viscosity in the range of from about 30 to about 12,000 mPa·s (milli Pascal seconds), alternatively in the range of from about 150 to about 5,000 mPa·s. Preferably, the detergent compositions of the present invention have a viscosity in the range of from about 100 to about 1,500 mPa·s, alternatively from about 150 to about 400 mPa·s. The detergent compositions herein may be in the form of a gel, pourable gels, non-pourable gels, or heavy-duty liquids.

"Gel" as used herein includes a shear thinning gel with a pouring viscosity in the range of from 1,000 to 5,000 mPa·s, in one embodiment less than 3,000 mPa·s, alternatively less than 1,500 mPa·s. Gels may include thick liquids. More generally, a thick liquid may be a Newtonian fluid, which does not change its viscosity with the change in flow condition, such as honey or syrup. This type of thick liquid is very difficult and messy to dispense. A different type of liquid gel is shear-thinning, i.e. it is thick under low shear (e.g., at rest) and thin at high flow rates. The rheology of shear-thinning gels is described in more detail in the literature, see for example WO 04\027010A1 Unilever.

Other compositions according to the present invention are pourable gels having a viscosity of at least 1,500 mPa·s but no more than 6,000 mPa·s, in one embodiment no more than 4,000 mPa·s, alternatively no more than 3,000 mPa·s, alternatively no more than 2,000 mPa·s.

Yet other compositions according to the present invention are non-pourable gels having a viscosity of at least 6,000 mPa·s but no more than 12,000 mPa·s, in one embodiment no more than 10,000 mPa·s, alternatively no more than 8,000 mPa·s and especially no more than 7,000 mPa·s.

Preferred liquid or gel form laundry treatment compositions herein include heavy-duty liquid laundry detergents for use in the wash cycle of automatic washing-machines and liquid finewash and/or color care detergents; these suitably have the following rheological characteristics: viscosity of no more than 1,500 mPa·s, in one embodiment no more than 1,000 mPa·s, alternatively, no more than 500 mPa·s. Very suitable compositions have viscosity of from 150 to 400 mPa·s and are either Newtonian or shear-thinning.

In these definitions and unless specifically indicated to the contrary, all stated viscosities are those measured at a shear rate of 21 s−1 and at a temperature of 25° C. Viscosity herein can be measured with any suitable viscosity-measuring instrument, e.g., a Carrimed CSL2 Rheometer at a shear rate of 21 $sec^{-1}$.

Organic Acidulant

The detergent compositions contain an organic acidulant in the form of an organic carboxylic acid or polycarboxylic acid. The organic acids preferably have equivalent weights that are less than or equal to about 80. The organic acids also preferably have its lowest pKa greater than or equal to about 2.5. Examples of organic acids that may be used herein include: acetic, adipic, aspartic, carboxymethyloxymalonic, carboxymethyloxysuccinic, citric, glutaric, glycolic, hydroxyethyliminodiacetic, iminodiacetic, itaconic, maleic, malic, malonic, oxydiacetic, oxydisuccinic, succinic, sulfamic, tartaric, tartaric-disuccinic, tartaric-monosuccinic. Particularly preferred are acids that can also serve as detergent builders such as citric acid. The laundry composition of the present invention contains from about 0.1 to about 15%, by weight of the composition, of the organic acidulant. In one embodiment the laundry composition contains from about 0.5 to about 10%, alternatively from about 1 to about 8%, by weight of the composition, of the organic acidulant.

Composition pH

The pH of the detergent composition (measured neat) will be preferably at least about 2.5, preferably at least 2.7. The pH of the detergent composition (measured neat) is less than about 3.0. The Neat pH of the detergent is obtained by the trim addition of an alkaline neutralizer, such as sodium hydroxide or sodium hydroxide solution to the composition at a level to obtain the desired Neat pH.

pH in Wash Water

The detergent compositions of the present invention are capable of delivering a pH to the wash water ("wash water pH"), when the detergent composition is added to the wash water (e.g., of a standard laundry washing machine) is less than 6.5, in one embodiment less than 6.2, alternatively less than 6.0.

In practical terms, the detergent compositions of the present invention are provided to the wash water in a sufficient amount such that the wash water contains from about 0.02% to about 4%, by weight of the wash water, of the detergent composition. In one embodiment, the wash water contains from about 0.03% to about 3%, by weight of the wash water, of the detergent, alternatively from about 0.04% to about 2% (about 400 to about 20000 ppm).

In one embodiment, the composition has a pH of from about 6 or less when diluted about 1000 fold in water having an alkalinity of less than or equal to 60 ppm CaCO3 when measured by EPA method #310.1 for "Titrimetric Determination of Tap Water Alkalinity".

Enzymes

The compositions of the present invention may contain less than about 1% of enzymes, alternatively, the compositions of the present invention may be substantially free of enzymes. As used herein "substantially free of enzymes" means that no enzymes are purposefully added to the formulation, but yet it is understood to one of ordinary skill in the art that trace amounts of enzymes may be present as impurities in other additives.

Where the compositions herein do contain enzymes, the enzymes should be selected from those that are compatible with an acid environment, including proteases, amylases, and mixtures thereof. Examples of acid proteases include Promod® 24L, 144L and 671L produced by Biocatalysts, and Protease A and Protease B produced by Amano and GC 106 and Fungal Acid Protease 500000 produced by Genencor. Other acid proteases are disclosed in U.S. Pat. No. 6,066,610 and U.S. Pat. No. 6,376,449. Amylases found to be functional under acidic washing conditions include Duramyl, Fungamyl and Natalase produced by Novozymes.

Fatty Acid Components

The compositions of the present invention may contain less than about 1% of fatty acid components, alternatively, the compositions of the present invention may be substantially free of fatty acid components. As used herein "substantially free of fatty acid components" means that no fatty acid components are purposefully added to the formulation, but yet it is understood to one of ordinary skill in the art that trace amounts of fatty acid components may be present as impurities in other additives.

Examples of fatty acids include linear and branched, saturated and mono- and polyunsaturated carboxylic acids having from 8 to 22 carbon atoms and their salts.

Other Laundry Adjuncts

The compositions of the present invention may contain one or more additional laundry adjuncts such as dyes, hueing dyes, chelants, stabilizers, radical scavengers, perfumes, fluorescent whitening agents, suds-supressors, soil-suspension polymers, soil release polymers, dye-transfer inhibitors, fabric softening additives, rheology modifiers, and other polymers.

Dyes

The compositions of the present invention may contain a dye to either provide a particular color to the composition itself (non-fabric substantive dyes) or to provide a hue to the fabric (hueing dyes). In one embodiment, the compositions of the present invention may contain from about 0.0001 to about 0.01% of a non-fabric substantive dye and/or a hueing dye.

Hueing Dye

The compositions of the present invention may contain a hueing dye. Examples of hueing dyes useful herein include Basic Violet 3 (Cl 42555) and Basic Violet 4 (Cl 42600), both commercially available from Standard Dyes, and Liquitint Violet 200 from Milliken Company.

Bleaching Agent

The compositions of the present invention may contain a bleaching agent. In one embodiment, the compositions of the present invention may contain from about 0.10% to about 10%, by weight of the composition, of a bleaching agent.

Bleaching agents useful herein include hydrogen peroxide or peroxyacids such as 6-phthalimidoperoxyhexanoic acid.

Chelants

The compositions of the present invention may contain a chelant. Chelants useful herein include DTPA, HEDP, DTPMP, dipicolinic acid, and mixtures thereof.

Radical Scavenger

The compositions of the present invention may contain a radical scavenger which may be used with liquid hydrogen peroxide to provide stability. Radical scavengers useful herein include trimethoxybenzoic acid.

Perfumes

The compositions of the present invention may contain an acid-stable perfume.

Fluorescent Whitening Agent

The compositions of the present invention may contain a fluorescent whitening agent. Fluorescent whitening agents useful herein include those that are compatible with an acidic environment such as Tinopal CBS-X.

Suds-Supressors

The compositions of the present invention are designed to be essentially free of suds suppressors. The embodiments may contain a very small level of suds suppressor for the purpose of reducing foaming during the packaging of the products. In this case the product may comprise less than or equal to about 0.02% suds suppressor. Examples of suppressors useful herein include silica/silicone type, silicone oil, branched alcohols, and mixtures thereof.

Soil Suspension Polymers

The compositions of the present invention may contain a soil suspension polymer. In one embodiment, the soil suspension polymer is selected from PEI ethoxylates, HMDA diquate ethoxylates, sulfonated derivatives, hydrophobically modified anionic copolymers. Particularly preferred are PEI with MW=182 and an average degree of ethoxylation=15, PEI with MW=600 and an average degree of ethoxylation=20, hexamethylenediamine dimethyquat with an average degree of ethoxylation=24, and hexamethylenediamine dimethyquat with an average degree of ethoxylation=24 (disulfonated). Examples of hydrophobically modified anionic copolymers useful herein include Acusol 480®, commercially available from Rohm and Haas and Alcosperse® 725 and 747 and Alcogum L520, commercially available from Alco Chemical.

Soil Release Polymers

The compositions of the present invention may contain a soil release polymer. In one embodiment, the soil release polymer is a PET alkoxylate short block copolymer, anionic derivative, or mixture thereof.

Dye Transfer Inhibitors

The compositions of the present invention may contain a dye transfer inhibitor and/or a dye fixative. Examples of dye transfer inhibitors useful herein include polyvinylpyrrolidone, poly-4-vinylpyridine-N-oxide, copolymers of N-vinyl-2-pyrrolidone and N-vinylimidazole and mixtures thereof. Useful dye fixatives for this application are disclosed in U.S. Pat. No. 6,753,307.

Fabric Softening Additives

The compositions of the present invention may contain a fabric softening additive. Examples of fabric softening additives useful herein include alkyl quaternary ammonium compounds, ester quaternary ammonium compounds, silicones, cationic silicones, and mixtures thereof.

Rheology Modifiers

The compositions of the present invention may contain a rheology modifier. Rheology modifiers useful herein include methylcellulose, hydroxypropylmethylcellulose, xanthan gum, gellan gum, guar gum and hydroxypropyl guar gum, succinoglycan, and trihydroxystearin. Particularly preferred are methylcellulose and hydroxypropylmethylcellulose thickeners available under the Methocel® trade name from Dow Chemical and Alcogum L520 from Akzo Nobel. When used herein, the detergent compositions of the present invention contain from about 0.01 to about 1%, by weight of the composition, of a rheology modifier. In one embodiment, the compositions herein contain from about 0.02 to about 0.75%, alternatively from about 0.05% to about 0.5%, by weight of the composition, of the rheology modifier.

Structurant

In some embodiments of the present invention, the liquid laundry detergent compositions further comprise structurant. Structurants of use include those disclosed in USPN 2006/0205631A1, 2005/0203213A1, U.S. Pat. Nos. 7,294,611, 6,855,680. U.S. Pat. No. 6,855,680 defines suitable hydroxy-functional crystalline materials in detail. Preferred is hydrogenated castor oil. Non-limiting examples of useful structurants include those selected from the group of: hydrogenated castor oil; derivatives of hydrogenated castor oil; microfibrillar cellulose; hydroxyfunctional crystalline materials, long-chain fatty alcohols, 12-hydroxystearic acid; clays; and mixtures thereof. In some embodiments, Alternately, low molecular weight organogellants can be used. Such materials are defined in: Molecular Gels, Materials with Self-Assembled Fibrillar Networks, Edited by Richard G. Weiss and Pierre Terech.

EXAMPLES

The Liquid detergent formulas shown in Table 1 were prepared. Examples a, b, c, and d are comparative examples from US 2006/0111261 A1. Examples e, f, g, h are in accord with the present invention.

TABLE 1

| | Formula | | | | | | | |
|---|---|---|---|---|---|---|---|---|
| | a comp | b comp | c comp | d comp | e | f | g | h |
| | | example from US 2006/0111261 A1 | | | | | | |
| | 3d wt % | 4e wt % | 4f wt % | 4g wt % | inv wt % | inv wt % | inv wt % | inv wt % |
| linear alkyl benzene sulfonic acid | 14.0% | 6.3% | 6.0% | 3.5% | 8.3% | 10.4% | 4.1% | 5.2% |
| C12-13 EO9 alkyl ethoxylate | 7.5% | 12.8% | 2.8% | 5.3% | | | | |
| C12-14 EO9 alkyl ethoxylate | 0.9% | 0.9% | 0.2% | 0.2% | 10.7% | 8.6% | 5.4% | 4.3% |
| amine oxide | | | 1.0% | 1.0% | | | | |
| citric acid | 4.1% | 4.1% | 3.5% | 5.0% | 9.5% | 9.5% | 9.5% | 9.5% |
| Ethanol | 2.0% | 2.0% | | | | | | |
| sodium hydroxide | 0.27% | 0.58% | 0.16% | 0.58% | | | | |
| ethanolamine | 2.60% | 1.20% | 1.10% | 0.70% | 2.15% | 2.56% | 1.37% | 1.57% |
| ethoxylated PEI polymer | 1.60% | 1.60% | 0.05% | 0.05% | 1.87% | 1.87% | 1.87% | 1.87% |
| DTPA, sodium salt | 0.2% | 0.2% | 0.1% | 0.1% | 0.3% | 0.3% | 0.3% | 0.3% |
| Tinopal CBS X | 0.20% | 0.20% | 0.05% | 0.05% | 0.12% | 0.12% | 0.12% | 0.12% |
| propanediol | 0.94% | 0.94% | 0.24% | 0.24% | 0.56% | 0.56% | 0.56% | 0.56% |
| Dye | 0.01% | 0.01% | 0.01% | 0.01% | 0.01% | 0.01% | 0.01% | 0.01% |
| Perfume | 0.2% | 0.2% | 0.2% | 0.2% | 0.2% | 0.2% | 0.2% | 0.2% |
| Silicone | 0.03% | 0.03% | | | | | | |
| water & miscellaneous | balance | balance | balance | balance | balance | balance | balance | balance |
| total surfactant | 22.40% | 20.00% | 10.00% | 10.00% | 19.00% | 19.00% | 9.50% | 9.50% |
| Hydrophilic Index | 8.36 | 11.17 | 7.71 | 9.68 | 10.00 | 9.00 | 10.00 | 9.00 |
| surfactant/organic acid ratio | 5.5 | 4.9 | 2.9 | 2.0 | 2.0 | 2.0 | 1.0 | 1.0 |
| neat pH of detergent | 2.71 | 3.31 | 2.50 | 3.50 | 2.52 | 2.51 | 2.52 | 2.52 |

The stain removal performance of the formulas was evaluated under North American conditions. Swatches stained with the soils shown in Tables 2 and 3 were washed with each treatment. Product dosages were 49.6 g for each formula in 17 gallons of wash water using Kenmore 600 top loading automatic washers, normal cycle, 90° F. wash, 60° F. rinse and 8 grain per gallon water having a tap water alkalinity of 105-112 ppm CaCO3 (measured according to EPA method 310.1) with an additional 2.5 kg of laundry ballast followed by tumble drying. Four sheets of WFK SBL 10999 test soil (dust/sebum) were added to each load of laundry along with clean 100% cotton knit, 50% cotton/50% polyester knit and 100% polyester twill test fabrics to monitor soil redeposition. Stain removal was measured using an image analysis technique and the results are reported in Table 2 and 3 as the absolute percent stain removal for the first formula listed and the difference in removal versus the first formula for the remaining formulas listed. A higher value indicates more stain removal. Data was analyzed via an analysis of variance technique. A letter beside a stain removal value indicates that value is significantly better at the 95% confidence level than the corresponding value for the treatment denoted by the letter.

The after wash vs before wash difference in CIE Whiteness Index values (D65 illumination) was also measured for the added test fabrics. A larger ΔWI CIE value indicates higher soil antiredeposition performance. Data was analyzed via an analysis of variance technique. A letter beside a ΔWI CIE value indicates that value is significantly better at the 95% confidence level than the corresponding value for the treatment denoted by the letter.

Table 2 shows the stain removal and whiteness maintenance values for example formulas a, b, e, and f. Table 3 shows the stain removal and whiteness maintenance values for example formulas c, d, g, and h.

TABLE 2

| | comparative a | comparative b | invention e | invention f |
|---|---|---|---|---|
| Stain removal | | | | |
| Gravy | 64.1 | −1.7 | −5.5 | −5.6 |
| Chocolate syrup | 73.3 | 0.2 | 1.4 a | 2.4 |
| Grass | 42.8 | 1.3 | −0.7 | −0.6 |
| Clay | 52.8 | 0.1 | 3.4 | 4.4 |
| Coffee | 71.8 | 0.1 | 2.2 | 2.3 |
| Blueberry | 61.0 | 1.6 | 0.5 | 2.3 a |
| Tea | 33.9 | 0.7 | 13.3 ab | 13.5 ab |
| Wine | 60.2 | 1.1 | 3.0 | 3.3 |
| Average | | −0.9 | 0.3 | 1.4 |
| Δ CIE Whiteness Index | | | | |
| 100% cotton knit | 2.5 | 3.2 | 3.0 a | 3.0 a |
| 50% cotton/50% polyester knit | 5.5 e | 5.0 e | 3.6 | 4.7 e |
| 100% polyester twill | 5.0 | 2.6 | 7.4 ab | 12.2 abe |
| Average | 2.7 | 3.6 | 4.7 | 6.6 |

TABLE 3

| | comparative c | comparative d | invention g | invention h |
|---|---|---|---|---|
| Stain removal | | | | |
| Gravy | 61.2 gh | −3.5 | −3.5 | −2.1 |
| Chocolate syrup | 73.0 | 1.5 | 2.1 | 1.1 |
| Grass | 37.0 h | 4.0 | −1.3 | −1.4 |
| Clay | 46.8 | 4.8 | 8.7 | 7.3 c |
| Coffee | 69.3 | 0.7 | 2.6 | 2.7 c |
| Blueberry | 57.3 | 0.3 | 2.2 | 3.2 cd |
| Tea | 27.2 | 4.7 | 20.7 cd | 19.8 cd |
| Wine | 56.2 | 0.3 | 6.7 cd | 5.2 cd |
| Average | | 1.0 | 2.9 | 2.2 |
| Δ CIE Whiteness Index | | | | |
| 100% cotton knit | 3.9 | 5.3 g | 3.4 | 6.1 cd |
| 50% cotton/50% polyester knit | 3.5 | 2.4 | 3.5 | 7.0 cdg |
| 100% polyester twill | 6.3 dg | 1.4 | 4.4d | 6.9 dg |
| Average | 4.6 | 3.0 | 3.8 | 6.7 |

Tables 2 & 3 show that the formulas of the present invention provide a higher combination of stain removal of certain stains and soil antiredeposition performance than the comparative formulas.

Table 4 shows low pH formulations i, j, k, and 1 that are disclosed in WO 06/55788A1 and are prepared by traditional means known to one of ordinary skill. An acidic composition according to the present invention is shown in formulation m.

TABLE 4

| | comparative i | comparative j | comparative k | comparative l | invention m |
|---|---|---|---|---|---|
| ingredient | wt % | wt % | wt % | wt % | wt % |
| C11.8 linear alkylbenzene sulfonic acid | 14.0 | 6.3 | 6.0 | 3.5 | 7.12 |
| Neodol 23-5 | | | | | |
| Neodol 23-9 | 8.4 | 13.7 | 3.0 | 5.5 | |
| Neodol 24-9 | | | | | 10.56 |
| amine oxide | | | 1.0 | 1.0 | |
| citric acid | 4.1 | 4.1 | 3.5 | 5.0 | 8.43 |
| DTPA[1] | 0.2 | 0.2 | 0.1 | 0.1 | 0.30 |
| ethanolamine | 2.6 | 1.2 | 1.1 | 0.7 | 1.5 |
| sodium hydroxide | to adjust pH | to adjust pH | to adjust pH | to adjust pH | to adjust pH |
| ethoxylated amine polymer | 1.6 | 1.6 | 0.05 | 0.05 | 1.87 |
| ethanol | 2.0 | 2.0 | | | |
| silicone suds suppressor | 0.03 | 0.02 | | | |
| Tinopal CBS-X | 0.2 | 0.2 | 0.05 | 0.05 | |
| perfume | 0.2 | 0.2 | 0.2 | 0.2 | |
| Liquitint Blue EM[2] | | 0.1-0.5 | 0.1-0.5 | 0.1-0.5 | |
| thickener | 0.1-0.5 | 0.1-0.5 | 0.1-0.5 | 0.1-0.5 | |
| water | balance | balance | balance | balance | balance |
| neat pH (of composition) | 2.7 | 3.3 | 2.5 | 3.5 | 2.5 |
| total surfactant | 22.4 | 20.2 | 10.0 | 10.0 | 17.68 |
| HI | 8.31 | 11.07 | 7.94 | 10.4 | 10.00 |
| surfactant/citric acid | 5.46 | 4.88 | 2.86 | 2.00 | 2.10 |
| Wash pH (10 minutes) | 6.99 | 7.64 | 7.58 | 7.70 | 6.33 |
| Suds (2 minutes) | 32.1 | 26.3 | | | 26.5 |
| Suds (10 minutes) | 28.5 | 17.4 | | | 16.5 |
| Tea Stain Cleaning | 36.3 | 17.7 | | | 40.9 |
| Red wine Stain Cleaning | 71.2 | 66.4 | | | 73.0 |
| Blueberry Stain Cleaning | 70.4 | 70.5 | | | 70.4 |

TABLE 4-continued

| | comparative i | comparative j | comparative k | comparative l | invention m |
|---|---|---|---|---|---|
| Whiteness (Incandescent, Avg) | 80.3 | 80.1 | | | 80.4 |
| Taco Grease Stain Cleaning | 72.4 | 60.8 | | | 63.0 |
| Canola Grease Stain Cleaning | 81.2 | 78.4 | | | 78.2 |

All measurements referenced herein are at room temperature (about 21.1° C.) and at atmospheric pressure, unless otherwise indicated.

The compositions of the present invention can include, consist essentially of, or consist of, the components of the present invention as well as other ingredients described herein. As used herein, "consisting essentially of" means that the composition or component may include additional ingredients, but only if the additional ingredients do not materially alter the basic and novel characteristics of the claimed compositions or methods.

All percentages, parts and ratios are based upon the total weight of the laundry detergent compositions of the present invention, unless otherwise specified. All such weights as they pertain to listed ingredients exclude carriers, diluents etc. that may occur in commercial forms of the materials, unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An acidic laundry detergent composition comprising:

a) from about 5% to about 18% by weight of the detergent of a surfactant system, wherein said surfactant system comprises anionic surfactant comprising alkyl benzene sulfonic acids and their salts, wherein said surfactant system further comprises nonionic surfactant, and wherein the surfactant system has a Hydrophilic Index of greater than or equal to about 9.00;

b) an organic acidulant at a level such that the ratio of surfactant system to organic acidulant is less or equal to about 3.0;

c) an alkaline neutralizer added in an amount necessary to raise the neat pH of the detergent composition above or equal to about 2.5 but no higher than or equal to about 3.0; and wherein the composition further comprises a laundry adjunct material comprising a brightener.

2. A laundry detergent composition according to claim 1 wherein the detergent composition is a liquid laundry detergent composition having a viscosity of from about 150 to about 1,500 mPa·s.

3. A laundry detergent composition according to claim 1 wherein the organic acidulant is citric acid.

4. A laundry detergent composition according to claim 1 wherein the composition is capable of providing a wash water pH, when added to the wash water, of less than about 6.2.

5. A laundry detergent composition according to claim 1 wherein the composition has a pH of from about 6.5 or less when diluted by about 700-fold.

6. A laundry detergent composition according to claim 1 wherein the composition further comprises from about 0.01% to about 1% of a rheology modifier.

7. A laundry detergent composition according to claim 6 wherein the rheology modifier is selected from the group consisting of methylcellulose, hydroxypropylmethylcellulose, xanthan gum, gellan gum, guar gum and hydroxypropyl guar gum, succinoglycan, trihydroxystearin, copolymers of ethyacrylate, dimethylaminoethylacrylate, alkylethoxyesters of acrylic acid and mixtures thereof.

8. A laundry detergent composition according to claim 7 wherein the rheology modifier is selected from the group consisting of methylcellulose, hydroxypropylmethylcellulose, and mixtures thereof.

9. A laundry detergent composition according to claim 1 wherein the composition is substantially free of enzymes.

10. A laundry detergent composition according to claim 1 wherein the composition is substantially free of fatty acid compounds.

11. A laundry detergent composition according to claim 1 wherein the composition comprises from about 0.5 to about 10% of the organic acidulant.

12. A laundry composition according to claim 1 wherein the laundry adjunct material further comprises builders, polymers, perfumes, or mixtures thereof.

13. A method of laundering fabrics which provides reduction of fabric dinginess, said method comprising the steps of:

a) providing a detergent composition according to claim 1;

b) providing a wash water;

c) introducing said detergent composition into said wash water in an amount sufficient to generate a pH of from about 5 to about 6.5 in the wash water.

14. A method according to claim 13 wherein after the detergent composition is introduced into the wash water, the wash water comprises from about 0.02 to about 4.0%, by weight of the wash water, of the detergent composition.

15. A laundry detergent composition according to claim 1 wherein the composition further comprises a hueing dye.

16. A laundry detergent composition according to claim 1 wherein the composition further comprises a chelant selected from the group consisting of DTPA, HEDP, DTPMP, dipicolinic acid, and mixtures thereof.

17. A laundry detergent composition according to claim 1 wherein the composition further comprises a soil suspension polymer selected from the group consisting of PEI ethoxylates, HMDA diquat ethoxylates, sulfonated derivatives, hydrophobically modified anionic copolymers, and mixtures thereof.

* * * * *